United States Patent [19]

Haley

[11] 4,434,565

[45] Mar. 6, 1984

[54] NON-SLIP OVERSHOE

[76] Inventor: Robert D. Haley, 2525 Robb Cir., Lakewood, Colo. 80215

[21] Appl. No.: 363,096

[22] Filed: Mar. 29, 1982

Related U.S. Application Data

[63] Continuation-in-part of Ser. No. 134,192, Mar. 27, 1980, abandoned.

[51] Int. Cl.[3] ..... A43B 1/10; A43B 3/16; A43B 13/26

[52] U.S. Cl. ..... 36/7.3; 36/7.6; 36/59 R

[58] Field of Search ..... 36/7.3, 7.1, 7.6, 7.7, 36/59 R, 67 R, 67 A, 107, 4

[56] References Cited

U.S. PATENT DOCUMENTS

| | | | |
|---|---|---|---|
| 287,748 | 10/1883 | White | 36/7.6 X |
| 736,082 | 8/1903 | Foreman et al. | 36/7.6 X |
| 1,211,619 | 1/1917 | Oehring | 36/59 R |
| 1,255,911 | 2/1918 | Morris | 36/59 R |
| 1,615,498 | 1/1927 | Anderson | 36/7.7 |
| 1,841,710 | 1/1932 | Byrne et al. | 36/59 R |
| 2,776,499 | 1/1957 | Giuntini | 36/59 R |
| 2,970,390 | 2/1961 | Brough et al. | 36/7.3 |
| 3,170,251 | 2/1965 | Patrick | 36/59 R |
| 3,643,352 | 2/1972 | Adair | 36/7.3 |
| 4,202,116 | 5/1980 | Dassler | 36/59 R |

FOREIGN PATENT DOCUMENTS

| | | | |
|---|---|---|---|
| 45633 | 4/1939 | Netherlands | 36/7.6 |
| 1257524 | 12/1971 | United Kingdom | 36/59 R |

*Primary Examiner*—James Kee Chi

*Attorney, Agent, or Firm*—William P. O'Meara; Bruce G. Klaas

[57] ABSTRACT

A non-slip overshoe having at least one thin metal plate operably attached to its lower surface. The plate is provided with a series of sharp projections to provide gripping on slippery surfaces. Fixed and removable plate attachment means are disclosed.

7 Claims, 10 Drawing Figures

Fig. 6
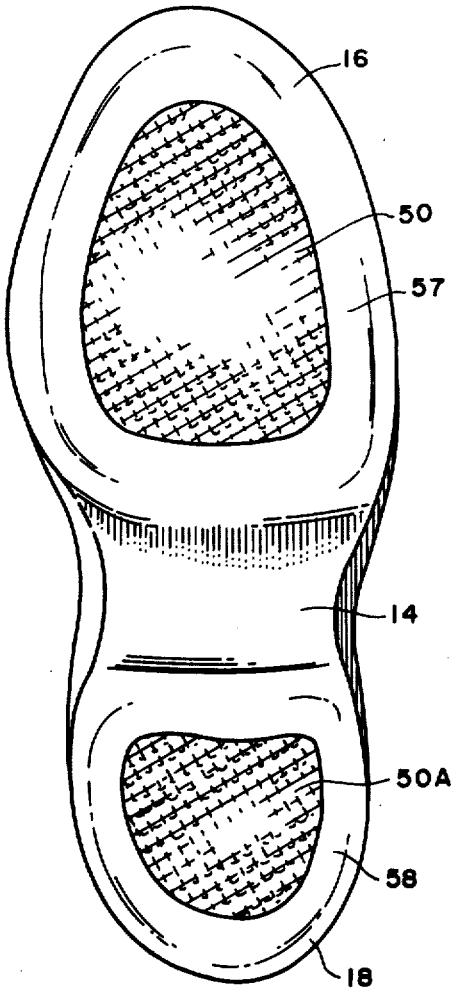
Fig. 7
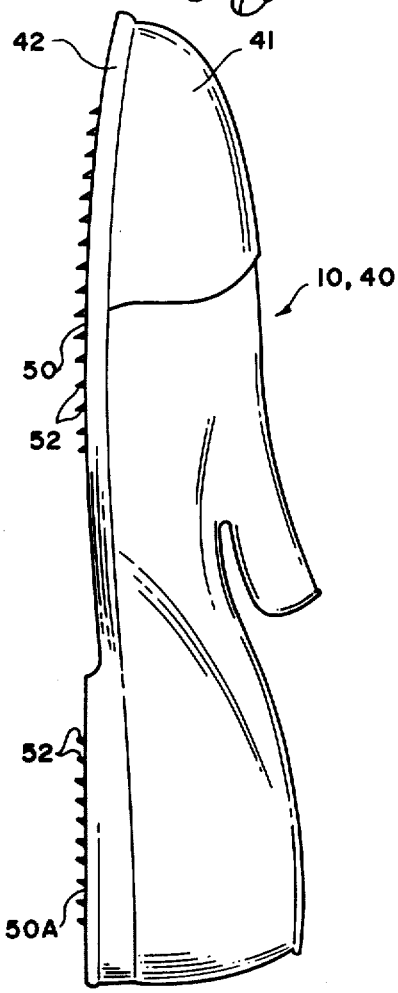
Fig. 8
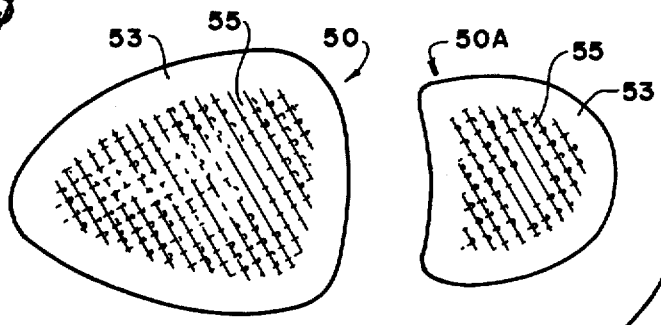
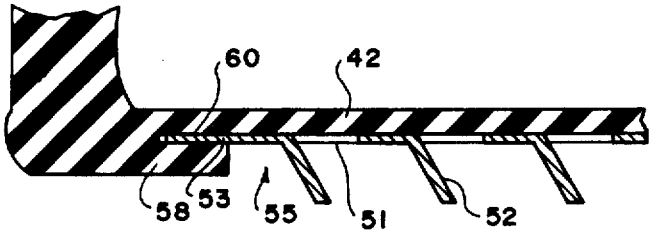
Fig. 9
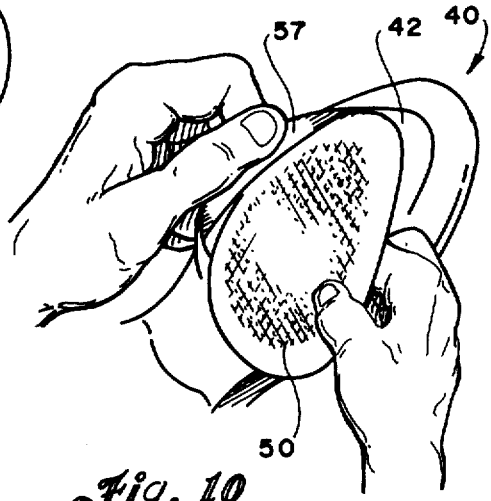
Fig. 10

NON-SLIP OVERSHOE

This application is a continuation-in-part of application Ser. No. 134,192 filed Mar. 27, 1980 abandoned on even date with the filing of this application.

BACKGROUND OF THE INVENTION

This invention relates to elastomeric overshoes with a myriad of small metal projections extending from the bottom of the sole and/or the heel of the overshoe.

PRIOR ART

Overshoes, of elastomeric material, have been made for years, particularly to protect the user's feet from water. The elastomeric material, e.g. rubber, synthetic rubber, plastics, resins and the like, have been formed into many types of footwear. This includes low cut overshoes or rubbers, hightop overshoes, buckle overshoes or arctics, boots (including fishing boots and waders), and the like. While the elastomeric material may be satisfactory for keeping water from the user's foot, the elastomeric material tends to become slippery on ice, particularly when wet and when the sole of the overshoe is somewhat smoothly worn. This is so, even when the original sole was waffled, serrated or roughened to prevent slipperiness.

Several, individual spaced apart spikes are formed into the sole of an overshoe in Kniffin U.S. Pat. No. 3,616,552, issued Nov. 2, 1971. This provides a unit similar to a golf shoe. The overshoe requires a thick sole to hold the individual spikes and prevent them from breaking through the sole.

U.S. Pat. No. 2,860,425 to Jackson dated, Nov. 18, 1958 shows an overshoe with a one piece same material waffled sole and heel, in an attempt to make the rubber overshoe non-skid.

Pietrocola U.S. Pat. No. 2,931,110 issued Apr. 5, 1960 teaches that a woman's rubber (overshoe) may be made with projections of polymeric material which is softer than the polymer of the overshoe. The projections extend through holes in the sole of the overshoe.

Boots with a series of projections of the molded sole material is known in Kimball U.S. Pat. No. 3,879,865, issued Apr. 29, 1975.

OBJECTS AND ADVANTAGES OF THE INVENTION

Included among the objects and advantages of the invention is to provide a non-skid polymeric, waterproof overshoe, or the like, formed with a thin sole, and an imbedded metal plate with a series of sharp projections extending through the bottom of the sole forming a non-skid sole even on wet ice.

Another object of the invention is to provide a lightweight polymeric overshoe with a myriad of sharp projections extending through the bottom of the sole forming a non-skid sole for an overshoe or the like.

Still another object of the invention is to provide a non-skid polymeric overshoe having a thin metallic plate molded in the molded sole and/or the heel of the footwear, and metal plate having a series of sharp projections extending through the bottom of the sole producing a non-skid surface even on wet, slippery ice.

Yet another object of the invention is to provide a polymeric overshoe having a molded sole and heel into which is molded a punched and expanded metal sheet covering the sole and/or the heel of the overshoe with the projections extending beyond the sole and heel bottom for contacting a walking surface.

An additional object of the invention is to provide a polymeric, waterproof overshoe having molded sole into which is molded a thin metal sheet with punched out teeth which extend through the molded material forming a non-skid sole.

Still yet another object of the invention is to provide a waterproof overshoe having an integrally formed flap for removeably and replaceably inserting non-skid, flexible, metal plate.

These and other objects and advantages maybe ascertained by reference to the following description and appended drawings.

GENERAL DESCRIPTION OF THE DRAWINGS

FIG. 6 is a bottom plan view of an overshoe sole with removable metal plates attached to a forward and heel portion of the sole.

FIG. 7 is a side view of the overshoe of FIG. 6.

FIG. 8 is a bottom plan view of the removable plates of FIGS. 6 and 7 detached from the overshoe.

FIG. 9 is an enlarged detailed cross-sectional side view of the heel plate attachment area of FIGS. 6 and 7.

FIG. 10 is a perspective view of a removable metal plate being inserted into an overshoe sole flap.

SPECIFIC DESCRIPTION OF THE INVENTION

The device of the invention is generally, a thin metal plate embedded in the molded sole and/or heel of an overshoe type of footwear, which is generally used over the normal shoes of a user. Such over-wear is formed of a polymeric material, which is an elastomer, either natural or synthetic, as natural rubber, synthetic rubber, as butyl rubber, neoprene, etc. The elastomer may also be synthetic plastic material as an alkylene polymer. e.g. polyethylene, polypropylene, etc.; other synthetic polymers as various types of vinyls, polycarbonates, polyurethanes, and many others. The main criteria is that the material is moldable, is generally soft and flexible, and is waterproof. Such material may be used alone as a molded overshoe or may include reinforcing as fabric, etc. The molding of the material, the shapes of the over-wear are well known.

Figure 1:
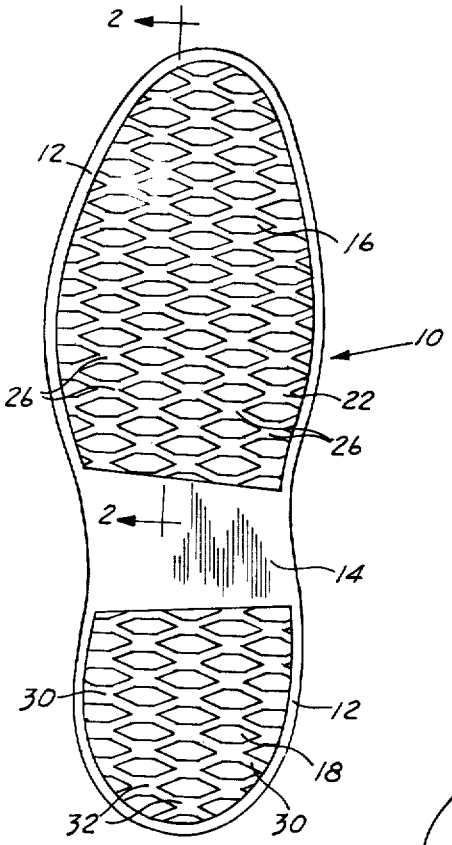
FIG. 1 is a bottom, plan view of a shoe sole, for overshoes or the like, showing punched and expanded metal, molded into the sole, with projections extending beyond the sole material.
Figure 2:
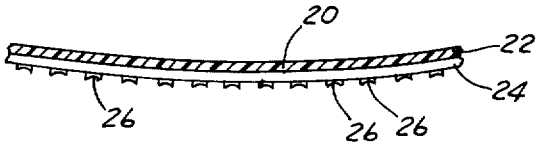
FIG. 2 is a detailed, cross-sectional view of a portion of the sole of the device of FIG. 1, taken on section lines 2—2.

The device of FIGS. 1-2 shows a sole of a waterproof overshoe, shown generally by numeral 10, having an edging of elastomerc material 12 extending around the shoe, and an arch area 14 between a sole area 16 and a heel area 18. The sole is molded and includes an upper elastomeric sole layer 20, FIG. 2, and a punched and expanded, thin metal plate 22 covered by a lower sole layer 24. The elastomeric material preferably adheres to the metal. The punched and expanded metal plate 22 is originally a thin, flat plate, which has a series of slits. When the plate is expanded or stretched, the lands between the slits which are adjacent lines of slits, twist and produce a series of sharp edge projections extending out of the plane of the plate. Thus, lands 26 raise and extend through the lower layer of the elastomeric material, producing a series of sharp edged, projections. These projections grip ice, making the sole and heel skid-proof.

The heel 18, also, includes an upper elastomeric layer, a punched and expanded metal plate 30, and a lower layer of the heel (the elastomeric layers are not specifically shown but are similar to the sole layers). The heel includes sharp edged projections 32, which extend through the lower layer of the heel elastomeric material.

Figure 5:
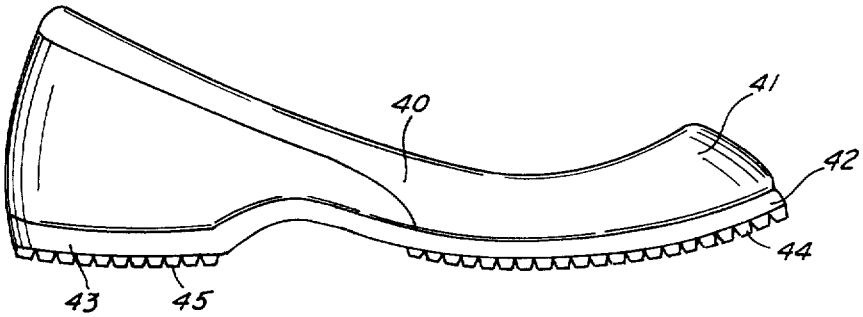
FIG. 5 is a side elevational view of one form of an overshoe using the metal plate according to the invention imbedded in the sole and a plate embedded in the heel with metal projections for a non-skid bottom.

As shown in FIG. 5, a low cut one piece overshoe or rubber 40 includes an upper portion 41, a sole 42, and a heel 43, all integrally molded of an elastomeric material, as is conventional. The sole and the heel have punched and expanded plates embedded therein, as explained above, providing sharp edged projections 44 and 45 from the twisted lands of the plate between the slits. In place of the low cut rubbers, high top boots, full boots, wadders, etc. may include the metal plate to provide the projections.

Figure 3:
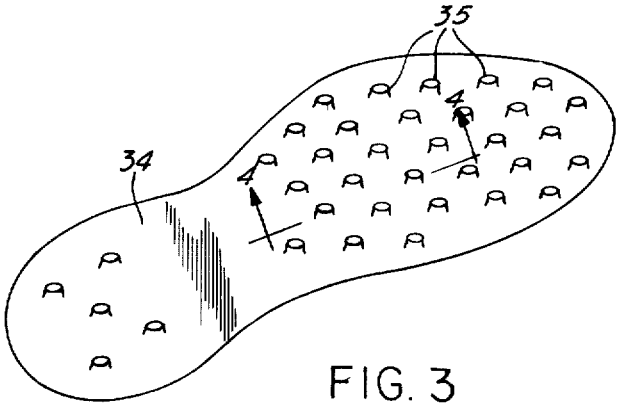
FIG. 3 is a plan view of a sole of an overshoe with an imbedded, thin metal sheet, having punched out teeth protruding out of the sole material.
Figure 4:
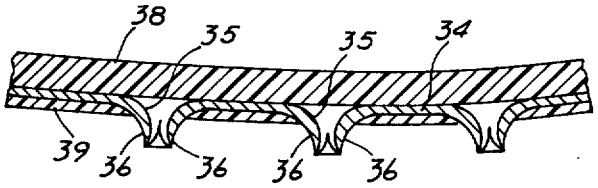
FIG. 4 is an enlarged detailed cross-sectional view of a portion of the sole of FIG. 3, taken along section line 4—4.

In the place of the punched and expanded metal plate, a metal plate 34, FIGS. 3–4, may have a series of holes 35, of rather large diameter, punched through the plate to produce a number of extending sharp prongs 36 around each hole 35. The prongs 36 represent the metal which has been pushed out of the holes 35, and this metal forms some 3 or more prongs 36 around the hole 35 depending on the punching tool. If the hole punching tool is used to produce the holes 35 from one side of the metal, the prongs 36 will extend generally perpendicular from the one surface of the plate. The plate 34 is embedded and preferably bonded with an elastomeric sole under the upper layer 38 and above the lower layer 39. The series of holes may be made in lines, and as many as desired or feasible.

The metal of the plates may be steel, and may be hardened after working to produce the prongs. These plates are generally thin, being on the order of 20 gauge plate to thicker plates. The thinner plates have more flexibility, which is an advantage with the plates with the punched out prongs, while a punched and expanded plate is flexible by virtue of the open spaces and the lattice work. The metal plates permit the use of thin sole layers and the weight of the user on the projections in contact with a surface is spread throughout the sole and/or heel. Thus, the weight distribution is even throughout the sole even if only a few prongs are in contact with a surface. This maintains the plate in between the layers in the sole.

As shown by FIGS. 6–10 an overshoe 10 such as rubber 40 may also be provided with removeable plate means such as a removable forward plate 50 and removable heel plate 50(A). The plates 50, 50(A) are attached to the rubber 40 by an attachment means such as resilient flaps 57, 58 intergrally formed with the rubber sole 42. The flaps 57, 58 may be stretched as shown by FIG. 10 to allow insertion of a plate 50. The plate is firmly held in the gap 60 formed by the upper surface of the flap 57, 58 and the lower surface of the sole 42. As illustrated by FIGS. 8 and 9 the removable plates 50, 50(A) have a smooth peripheral portion 53 which is encompassed by the flap 58. A pronged surface 55 comprising a planar surface 51 and downwardly depending prongs 52 is positioned inwordly of the area covered by the flaps 58 to provide a gripping surface. As illustrated by the FIGS. 7 and 9 the prongs 51 extend substantially beyond the lower surface of the flap 58 to insure adequate gripping contact with a walking surface. It may be seen from FIG. 7 that the prongs 52 may be given a bi-directional orientation to further facilitate gripping. In this embodiment the prongs on the forward plate 50 are sloped in a rearward direction to prevent skidding as a person strides forward off the ball of his foot. The heel plate 50(A) is provided with forward slopping prongs 52 to prevent a person from falling backwards as his heel strikes a slippery surface in the ending portion of a stride. The use of removable plates may greatly extend the life of the overshoe 10 by allowing relatively inexpensive replacement of the portion most subject to wear. The replacement feature also allows the overshoe 10 to be adapted to a variety of uses which may require different types of plates. For example, relatively thin flexible plates might be desired for use with rubbers 40 in ordinary street use, whereas thicker plates with longer prongs might be desired for use with overshoes 10 used in construction and the like.

It is contemplated that the inventive concepts herein disclosed may be variously otherwise embodied and it is intended that the appended claims be construed to include alternative embodiments of the invention except insofar as limited by the prior art.

What is claimed is:

1. An overshoe of the kind to be worn over the normal shoes of a wearer, comprising:
   a. an upper;
   b. a sole connected to the upper around the periphery of the sole and formed of resilient, flexible material;
   c. metal plate means for improving traction on slippery surfaces removably attached to the lower surface of said sole, said plate means extending throughout a substantial portion of the sole and comprising an upper surface and a lower surface, and having a plurality of projections extending outwardly therefrom substantially beyond said lower surface of said plate means; and
   d. metal plate attachment means for removably attaching said metal plate means to said sole;
   wherein said metal plate attachment means comprises resilient flap means fixedly attached to the lower surface of said sole for stretchably receiving said metal plate means.

2. An overshoe according to claim 1 wherein said flap means comprises a closed loop for encompassing a peripheral portion of said metal plate means.

3. An overshoe according to claim 1 wherein said flap means is integrally formed with said shoe.

4. An overshoe according to claim 2 wherein the peripheral portion of said plate means encompassed by said flap means comprises a smooth upper surface and a smooth lower surface.

5. An overshoe according to claim 4 wherein said flap means comprises a forward flap attached to a forward portion of said sole and a heel flap attached to a heel portion of said sole and wherein said plate means comprises a forward plate associated with said forward flap and a heel plate associated with said heel flap.

6. An overshoe according to claim 5 wherein said forward plate comprises projections sloping in a rearward direction and wherein said heel plate comprises projections sloping in a forward direction whereby said overshoe provides bi-directional stability to the wearer.

7. An overshoe according to claim 1, 2, 3, 4, 5, or 6 wherein said prongs project substantially beyond the lower surface of said flap means.

* * * * *